United States Patent [19]

Bourcier et al.

[11] Patent Number: 4,840,539

[45] Date of Patent: Jun. 20, 1989

[54] MOVING BLADING FOR STEAM TURBINES

[75] Inventors: Pierre Bourcier; Gilbert Riollet, both of Paris, France

[73] Assignee: Alsthom, Paris, France

[21] Appl. No.: 165,320

[22] Filed: Mar. 8, 1988

[30] Foreign Application Priority Data

Mar. 12, 1987 [FR] France ..... 87 03390

[51] Int. Cl.[4] ..... F01D 5/22

[52] U.S. Cl. ..... 416/191; 416/195

[58] Field of Search ..... 416/191, 195, 196 R

[56] References Cited

U.S. PATENT DOCUMENTS

| | | | |
|---|---|---|---|
| 1,061,648 | 5/1913 | Westinghouse | 416/191 |
| 1,544,318 | 6/1925 | Hodgkinson . | |
| 2,315,612 | 4/1943 | Franck | 416/191 |
| 2,391,623 | 12/1945 | Heppner | 416/191 |
| 2,430,140 | 11/1947 | Phelan et al. | 416/196 R X |
| 2,778,854 | 12/1956 | Anxionnaz . | |
| 3,004,750 | 10/1961 | Broders | 416/213 X |
| 3,014,695 | 12/1961 | Rankin et al. | 416/191 X |
| 3,752,599 | 8/1973 | Pace | 416/191 X |
| 3,981,615 | 9/1976 | Krol | 416/191 X |
| 3,986,792 | 10/1976 | Warner | 416/191 X |
| 4,083,655 | 4/1978 | Tempere . | |
| 4,243,360 | 1/1981 | Wright . | |
| 4,576,551 | 3/1986 | Olivier et al. | 416/191 |
| 4,699,569 | 10/1987 | Gloor | 416/191 |

FOREIGN PATENT DOCUMENTS

| | | | |
|---|---|---|---|
| 873151 | 6/1971 | Canada | 416/191 |
| 606351 | 11/1934 | Fed. Rep. of Germany | 416/191 |
| 1340331 | 9/1963 | France . | |
| 1374917 | 8/1964 | France | 416/191 |
| 1382057 | 11/1964 | France . | |
| 1403799 | 5/1965 | France . | |
| 1519898 | 2/1968 | France . | |
| 2329845 | 5/1977 | France . | |
| 2337251 | 7/1977 | France . | |
| 2432134 | 2/1980 | France . | |
| 132703 | 6/1986 | Japan | 416/195 |
| 985327 | 12/1982 | U.S.S.R. | 416/191 |
| 1503453 | 3/1978 | United Kingdom . | |

*Primary Examiner*—Everette A. Powell, Jr.

*Attorney, Agent, or Firm*—Sughrue, Mion, Zinn, Macpeak & Seas

[57] ABSTRACT

Moving blading for a steam turbine, the blading comprising blades (1) having respective bodies (3) provided with caps or fins (4), said caps or fins (4) on adjacent blades coming into contact at least during rotation of the blading over a plane surface which is substantially parallel to the radial axis (Z'Z) of the blade and giving rise to blade body twisting by virtue of said contacts (7, 8), the blading being characterized in that, in addition to the contacts (7 and 8) between adjacent caps or fins (4), it includes a link which is provided by means of additional contacts (A, A') free to slide rectilinearly in a plane corresponding to the plane of each cap or fin (4) along an axis which is substantially perpendicular to the axis of rotation OO' of the blading, said additional contacts (A, A') being situated at a relatively large distance from said contacts (7, 8) which give rise to twisting. The invention improves the vibration properties of the blades.

12 Claims, 7 Drawing Sheets

MOVING BLADING FOR STEAM TURBINES

The present invention relates to moving blading for steam turbines comprising blades having bodies provided with caps or fins, said caps or fins of adjacent blades being in contact, at least while the blading is rotating, over a plane surface which is substantially parallel to the radial axis of the blade with said contact twisting the blade bodies.

BACKGROUND OF THE INVENTION

The caps (or fins) clamped by torsion against a plane face substantially parallel to the radial axis Z'Z of the blade are poor at transmitting the dynamic moments Mz existing about said radial axis whenever the two contacting faces of adjacent caps (or fins) are not exactly parallel (see FIG. 3). As a result, the function performed by the contact face which is clamped by torsion depends on its quality of manufacture and this has the drawback of giving rise to dispersion in the vibration properties of each blade when taken separately. This dispersion has an effect on the entire moving blade by modifying its resonant frequencies in an uncontrolled manner and by giving rise to a greater number of resonant frequencies which makes it difficult to avoid resonance with known excitation frequencies.

Preferred embodiments of the present invention mitigate this drawback.

SUMMARY OF THE INVENTION

The present invention provides moving blading for a steam turbine, the blading comprising blades having respective generally radial bodies provided with transverse members (e.g. caps or fins) with the transverse members on adjacent blades coming into contact (at least during rotation of the blading) over plane surfaces which are substantially parallel to the radial axes Z'Z of the blades, said contacts causing the blade bodies to twist, wherein, in addition to said contacts between adjacent transverse members, the blading includes links provided by means of additional contacts which are free to slide rectilinearly in planes corresponding to the plane of each transverse member along respective axes which are substantially perpendicular to the axis of rotation 00' of the blading, said additional contacts being situated at a relatively large distance from said contacts that give rise to twisting.

The links set up between adjacent caps (or fins) by these additional contacts have the effect that relative motion of these caps (or fins) gives rise on each of them to points A and A' (which may be distinct or which may coincide) at which friction forces f and f' contained in the plane of the caps (or the fins) occur, which friction forces have a moment $-M_Z$ relative to the mean contact point C on the plane surface. The sum $M_Z+-M_Z$ may be different from one blade to another such that even in the extreme case where the faces clamped by torsion are incapable of transmitting the slightest moment between adjacent caps (or fins), said transmission is nevertheless provided by the $-M_Z$ (see FIG. 3). It is important for the points A and A' to be situated as far as possible from the contact faces so as to hinder as much as possible any rotation movement of the cap (or the fin) which may occur about a spot contact point C.

In a first embodiment of the invention, the additional contacts are constituted by extensions of the caps or fins whose top faces press against the top faces of complementary cavities provided in the adjacent caps or fins.

In this case, the point A of one blade coincides with the point A' of the adjacent blade.

In a second embodiment of the invention, the additional contacts are provided by link members situated in grooves opening out into the side surfaces of the caps or fins furthest from the contacts that give rise to twisting, said members rubbing against the walls of said grooves.

BRIEF DESCRIPTION OF THE DRAWINGS

Embodiments of the invention are described by way of example with reference to the accompanying drawings, in which.

MORE DETAILED DESCRIPTION

Figure 1:
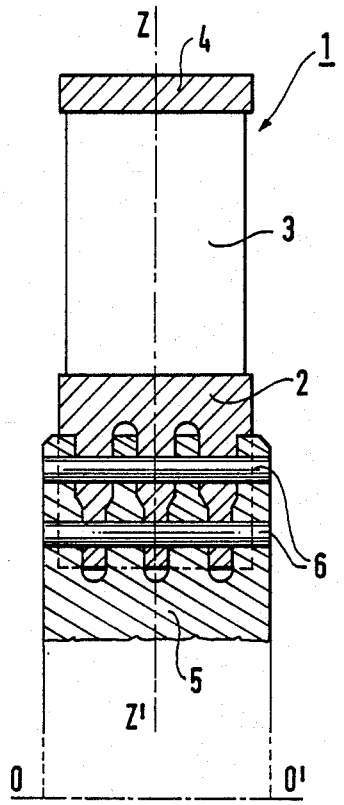
FIG. 1 is a section through a conventional blade taken perpendicularly to its mid-plane.
Figure 2:
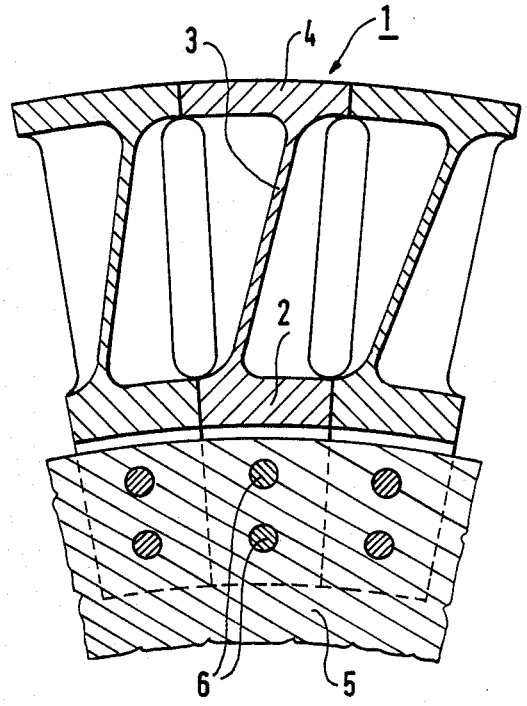
FIG. 2 is a section through a portion of conventional blading constituted by the FIG. 1 blades, with the section being in a plane parallel to the mid-plane of the blades.
Figure 3:
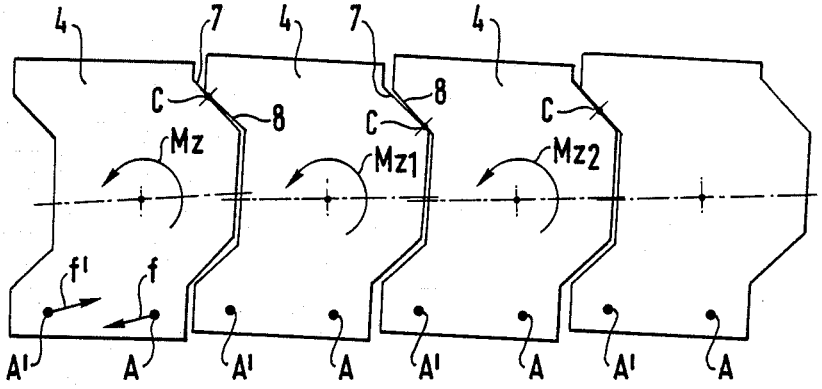
FIG. 3 is a plan view of the FIG. 2 blading.

The conventional blading shown in FIGS. 1, 2, and 3 comprises blades 1, each comprising a root 2, a body 3, and a cap 4. Pins 6 lock the roots 2 of the blades 1 in a central core 5 constituting a portion of the rotor of the turbine. Each cap 4 has a front face 7 which is at a slope relative to the vertical mid-plane P which is substantially parallel to the radial axis (z'z) of the blade, and a rear face 8 which is substantially parallel to the front face 7, with the front and rear faces 7 and 8 of all of the blades being situated on the same side of the mid-plane P. The moving blading is rotateable about the axis 00'.

When the roots 2 of the blades 1 are put into place, the front face 7 of each blade 1 presses against the rear face 8 of the blade 1 situated ahead thereof, and the faces 7 and 8 rotate towards the normal to the mid-plane. The body 3 of each blade 1 is thus twisted under the effect of the forces which the adjacent blades 1 apply on their front and rear faces.

In fact, by virtue of machining defects in the faces 7 and 8 of the blades, contact between a pair of adjacent blades can only occur over a portion of the facing faces. This portion may be limited by a very narrow zone about an average point C which is different from blade to blade. Dynamic moments $M_Z$, $M_{Z1}$, and $M_{Z2}$ about the radial axes of the blades (zz') are poorly transmitted given the limited contact between the faces 7 and 8. In order to transmit these moments, the present invention provides a link between adjacent caps 4 by additional contacts A and A' such that relative movement of the caps 4 gives rise to friction forces f and f' at the points A and A' contained in the plane of each cap, thereby generating a moment $-M_Z$ for transmitting all or a part of the moment between adjacent caps.

FIGS. 2 and 3 show blades whose caps are pressed against one another under the effect of torsion forces in the blade bodies at rest, however it is also known practice to mount the caps so they are spaced apart, with the caps being pressed against one another only when the blades are rotated and their bodies untwist under the effect of centrifugal force.

Figure 4:
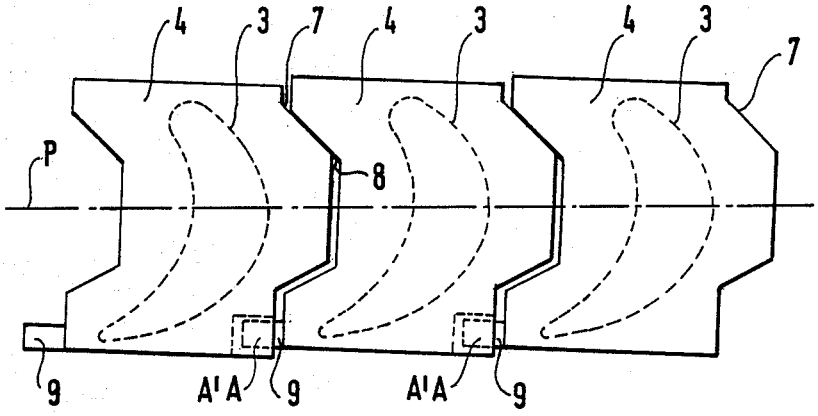
FIG. 4 is a plan view of a portion of blading in accordance with a first embodiment of the invention.
Figure 5:
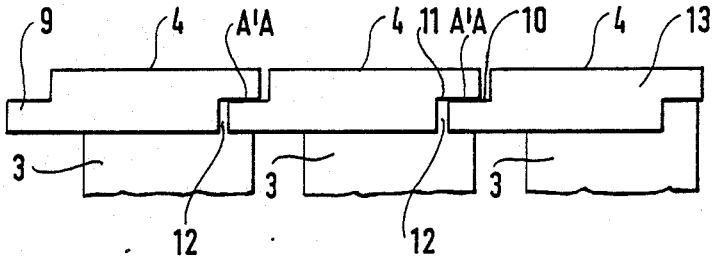
FIG. 5 is a side view of the FIG. 4 blading portion.
Figure 6:
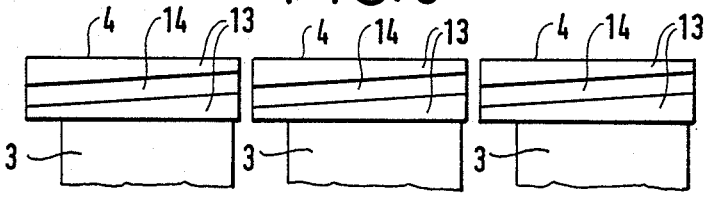
FIG. 6 is a diagrammatic side view of a portion of blading in accordance with a second embodiment of the invention prior to the installation of linking shims.
Figure 7:
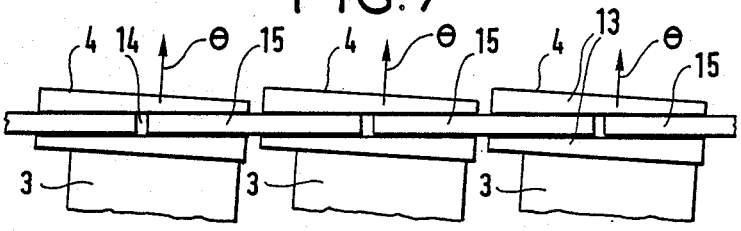
FIG. 7 is the same view as FIG. 6 after the shims have been put into place.
Figure 8:
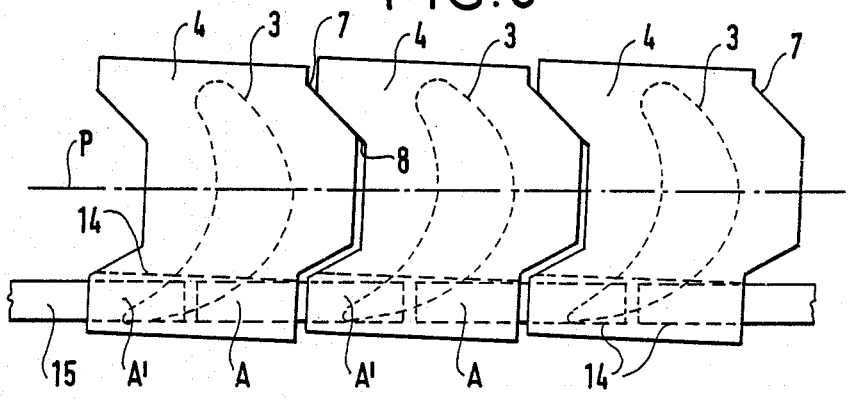
FIG. 8 is a plan view of the FIG. 7 blading.
Figure 9:
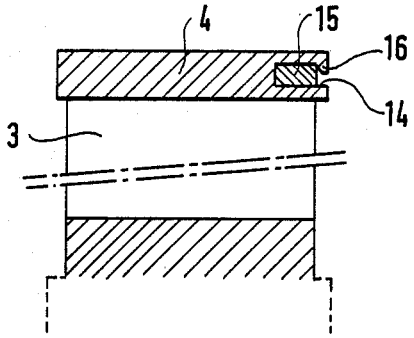
FIG. 9 is a section through the blading of FIGS. 7 and 8 in a plane perpendicular to the mid-plane and passing through the axis of the turbine.

An embodiment of blading in accordance with the invention is shown in FIGS. 4 and 5. On the side opposite to the contacting faces 7 and 8, the cap 4 of each blade is provided with an extension 9 which is generally rectangular in shape having a top face 10 that rubs against the top face 11 of a complementary cavity 12 provided in the adjacent blade. The extension 9 and the cavity 12 are situated on the side surface 13 of the caps 4 which is situated on the opposite side of the plane P to the contacting faces 7 and 8.

Contact may be obtained between the face of the extension 9 and the face of the complementary cavity by prestressing at rest and/or by deformation due to centrifugal forces.

In this embodiment, the point A on each blade coincides with the point A' of the adjacent blade.

In a second embodiment of the invention shown in FIGS. 6 to 9, the caps 4 are provided with respective machined grooves 14 opening out on the side surfaces 13 of the caps 4 furthest from the contact faces 7 and 8.

The grooves 14 of adjacent blades 1 do not lie in line with one another.

Shims 15 are disposed in the grooves 14 with each shim 15 being engaged in two consecutive caps 4. The shims are spaced apart from one another, and their ends come nearly up to the middles of the side surfaces 13 of the caps.

In order to put the shims 15 into place, it is necessary to bend the blades 1, and friction between the shims 15 and the grooves 14 of the blades 1 is thus obtained while the blading rotates.

Each groove 14 is provided with a peripheral tooth 16 in the top thereof which prevents the shims 15 from escaping during rotation of the blading.

The teeth 16 are folded down after the shims 15 have been put into place in the grooves 14.

In a variant of this second embodiment as shown in FIGS. 10 to 14, the caps 4 have grooves 14 which are in line when the blading is not rotated. However, under the effect of centrifugal force, the bodies 3 of the blades 2 tend to bend (FIG. 11) unless the link members are present in the grooves 14.

A shim element constituted, for example, by a flat wire 17 is inserted to oppose the bending of the blades 1 under the effect of centrifugal force and to develop friction forces. This wire may be constituted by four circumferential quarters.

Figure 14:
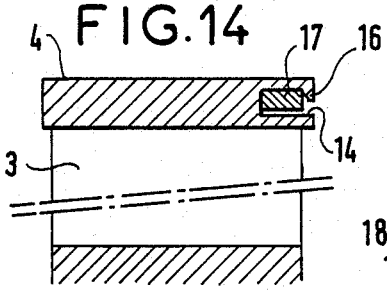
FIG. 14 is a section through one blade of the blading of FIGS. 12 and 13, said section being on a plane perpendicular to the mid-plane and passing through the axis of the turbine.

The groove 14 opens out into the side surface 13 of the caps 4 on the side opposite from the contact faces 7 and 8, and it may be provided with a rim 16 preventing the shim wire 17 from escaping from the groove 14 while the blading is rotating (see FIG. 14).

Figure 15:
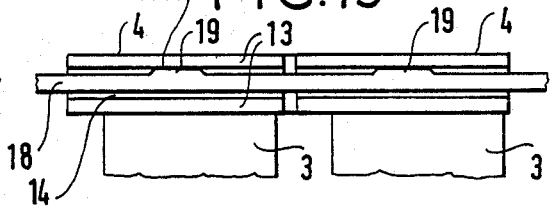
FIG. 15 is a side view of a portion of blading in accordance with another variant of the second embodiment of the invention, with the tooth being removed.

In a second variant shown in FIG. 15, the grooves 14 are in line with another at rest and they remain in line when the blading is rotated.

A link element such as a flat wire 18 is inserted in the groove.

The wire 18 has projections 19 lying towards the middles of the grooves 14, which projections 19 rub against the top walls of the grooves 14 when the blading is rotating.

As in the second embodiment, each groove 14 is situated on the side surface 13 of the caps 14 opposite from the contact faces 7 and 8, and it may be provided with a rim 16 preventing the shim wire 18 from escaping from the groove 14.

Figure 10:
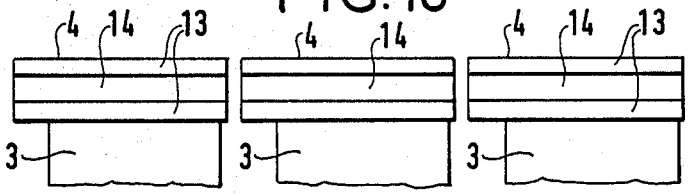
FIG. 10 is a diagrammatic side view of a portion of blading in accordance with a variant of the second embodiment of the invention prior to mounting the linking means and shown in the rest position.
Figure 11:
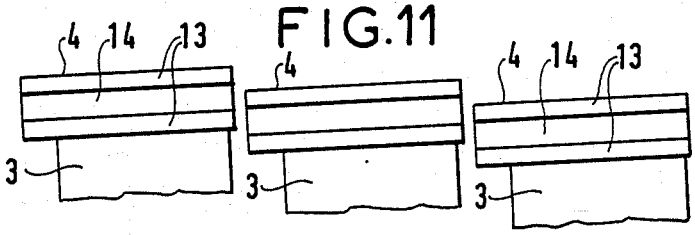
FIG. 11 is the same view as FIG. 10 showing the blading in rotation.
Figure 12:
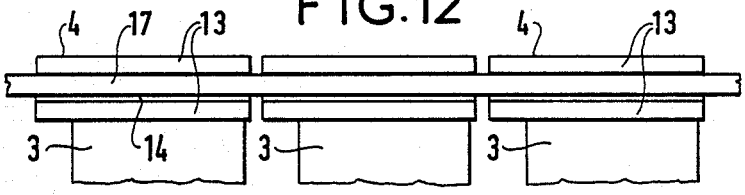
FIG. 12 shows the blading of FIGS. 10 and 11 after the link means have been assembled.
Figure 13:
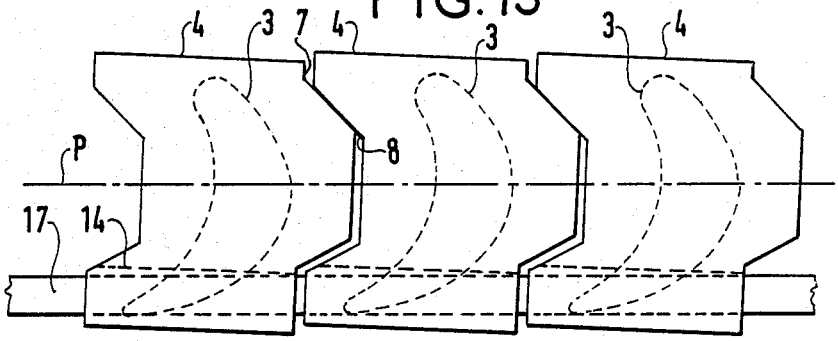
FIG. 13 is a plan view of the FIG. 12 blading.
Figure 16:
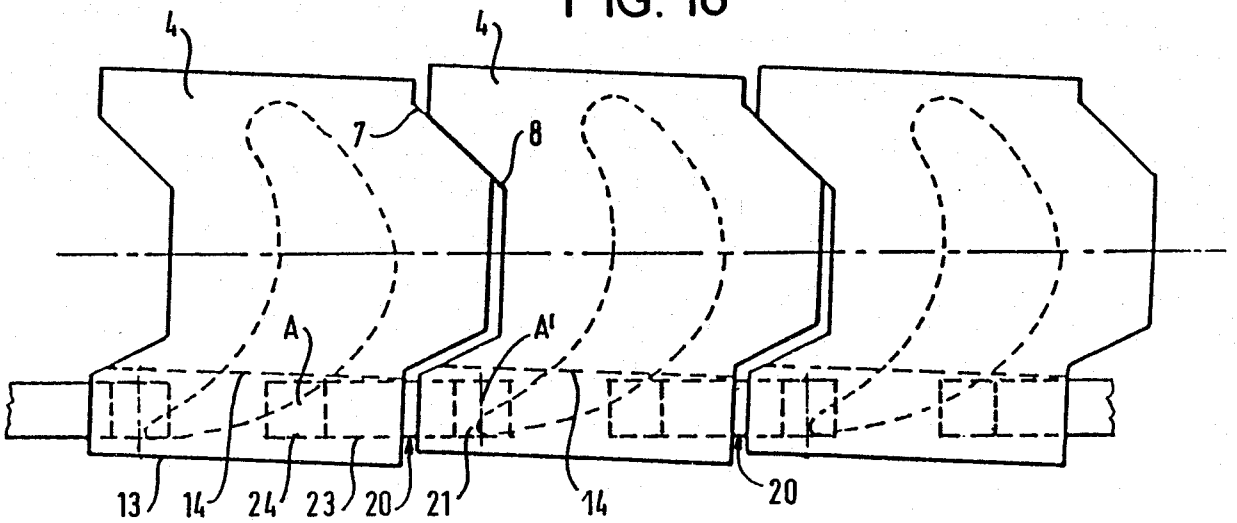
FIG. 16 is a plan view of a third embodiment of the blading.
Figure 17:
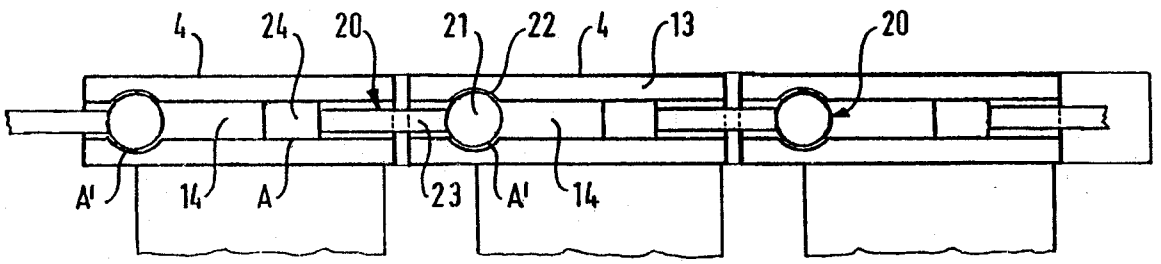
FIG. 17 is a side view of the FIG. 16 blading, with the tooth being removed.

In a third embodiment of the invention shown in FIGS. 16 and 17, a bar shaped member 20 is inserted in the groove 14 opening out into the side surface 13 of each cap 4 opposite from its faces 7 and 8, and the grooves while at rest are as shown in FIG. 10.

At one end of each member 20 there is a shaft 21 extending parallel to the axis of rotation 00' of the blading, which shaft is received by sliding into a bore 22 formed in the walls of the groove 14. The shaft 21 of the member 20 is connected by an arm 23 to a cube-shaped mass 24 situated in the groove of the cap 4 adjacent to the cap in which the shaft 21 is received.

Thus, when the caps 4 vibrate, the shafts 21 of the members 20 are free to rotate and friction forces are generated between the masses 24 and the walls of the grooves 14.

As above, each groove 14 is provided with a peripheral tooth 16 which prevents the members 20 from escaping from the grooves 14.

Figure 18:
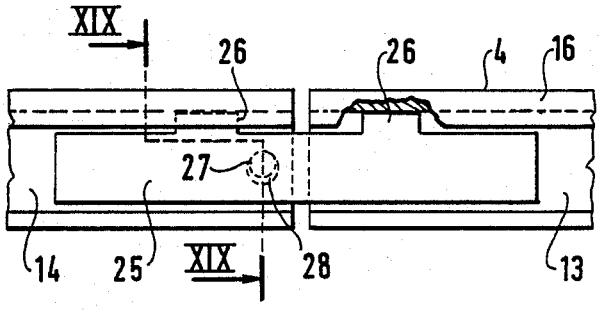
FIG. 18 is a side view of a variant of the third embodiment.
Figure 19:
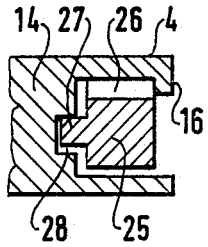
FIG. 19 is a section through the FIG. 18 variant.

In a variant of the third embodiment of the invention, as shown in FIGS. 18 and 19, bar-shaped members 25 having two thrust surfaces 26 are inserted in the grooves 14 which open out into the side surfaces 13 of the caps 4 opposite to the surfaces 7 and 8, with the grooves 14, when at rest, being as shown in FIG. 10.

The bars 25 straddle the grooves 14 of two adjacent caps 4 with one of their bearing surfaces 26 being in each of the grooves 14. The bars 26 are prevented from moving tangentially by studs 27 and they are prevented from moving axially by teeth 16.

Each stud 27 is loosely received in a housing or recess 28 in the corresponding groove 14.

In the above-described embodiments, the bodies 3 of the blades are terminated by caps; however, the bodies could alternatively be fitted with fins 4 situated at an intermediate level.

Figure 20:
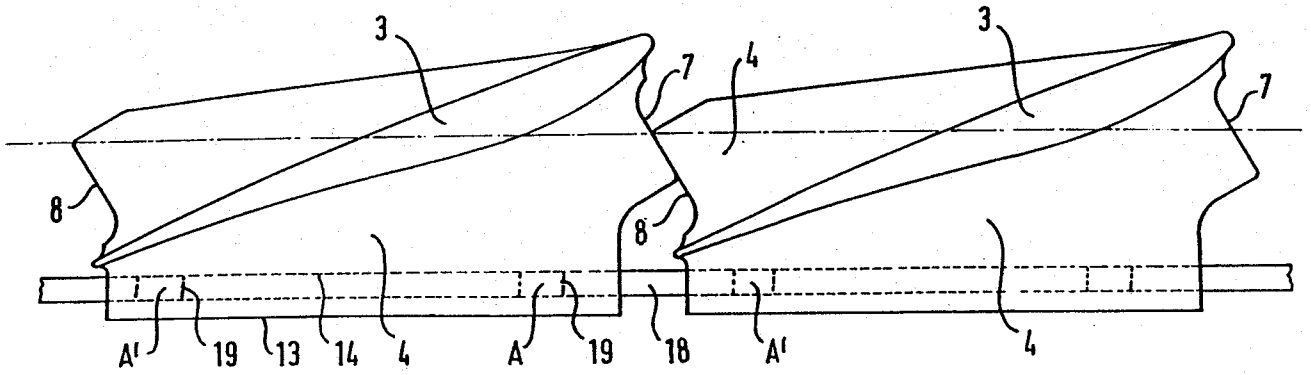
FIG. 20 shows an embodiment of blading including fins.
Figure 21:
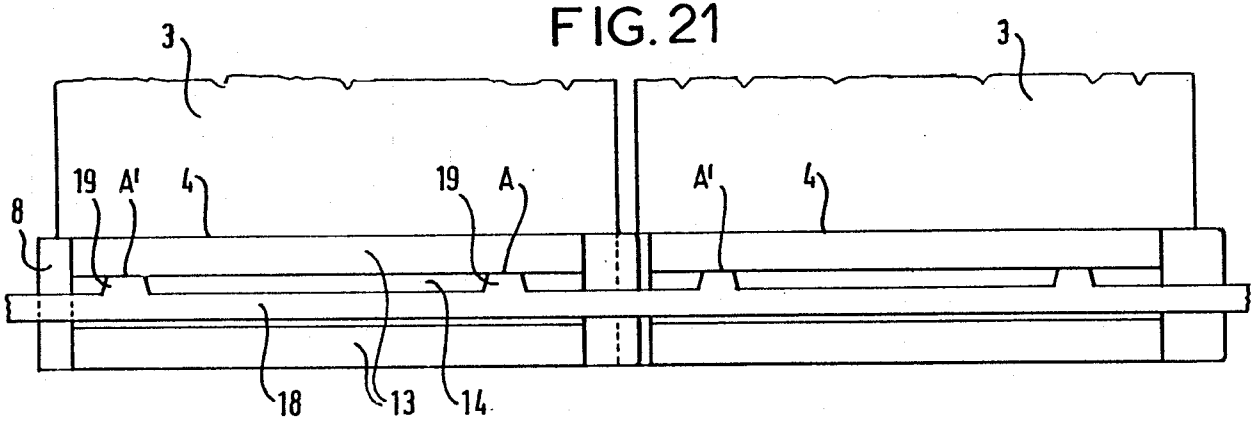
FIG. 21 is a side view of the FIG. 20 blading with the tooth removed.

The embodiment shown in FIGS. 20 and 21 is a fragmentary view of blading provided with fins 4 mounted on the blade bodies 3 with the fins being clamped against one another via contact faces 7 and 8, and each including a groove 14 opening out in a side surface 13 which is opposite from the side faces 7 and 8.

A flat wire 18 is inserted into the grooves, said wire having two projections 19 per fin 4, which projections rub against the top walls of the grooves 14 when the blading is in rotation.

We claim:

1. Moving blading for a steam turbine, the blading comprising a plurality of blades having respective generally radial bodies provided with transverse members with the transverse members on adjacent blades in contact, at least during rotation of the blading over plane surfaces which are substantially parallel to radial axes Z'Z of the blades, said contact causing the blade bodies to twist, the improvement wherein, in addition to said contact between adjacent transverse members, said blading includes links provided by means of additional contacts which are free to slide rectilinearly in planes corresponding to the plane of each transverse member along respective axes which are substantially perpendicular to the axis of rotation 00' of the blading, said additional contacts being situated at a relatively large distance from said contact that gives rise to twisting.

2. Moving blading according to claim 1, wherein said transverse members have top faces and said additional contacts are constituted by extensions and complimentary cavities of said transverse members with top faces of said extensions pressed against top faces of complementary cavities provided in the adjacent transverse members.

3. Moving blading according to claim 1, wherein said additional contacts are provided by link members situated in grooves opening out into those side surfaces of said transverse members which are furthest from said contact that gives rise to twisting, with said link members rubbing against the walls of said grooves.

4. Moving blading according to claim 3, wherein said link members are inserted into the grooves with the blades bent and the direction of the grooves of adjacent transverse members are substantially parallel but do not lie in line with one another.

5. Moving blading according to claim 4, wherein said link members are constituted by shims interconnecting pairs of adjacent blades.

6. Moving blading according to claim 3, wherein the tops of the grooves are provided with respective teeth.

7. Moving blading according to claim 3, wherein said link members are inserted into the grooves of unbent blades and the direction of the grooves of adjacent transverse members are substantially parallel and are in line with each other when the blade is rotating.

8. Moving blading according to claim 7, wherein said link members are constituted by bars each having a shaft at one end which is parallel to the axis 00' of rotation of the blading, said shaft being received without sliding in the groove of one of the blades, the bars also each having a mass connected by an arm to the shaft and sliding in the groove of the adjacent blade while rubbing against its walls.

9. Moving blading according to claim 7, wherein said link members are constituted by bars each comprising two bearing surfaces received in the grooves of two adjacent blades, the bars being provided with respective studs received loosely in respective housings in the groove of one of said blades.

10. Moving blading according to claim 7, wherein the link members are constituted by wires interconnecting a plurality of adjacent blades.

11. Moving blading according to claim 10, wherein the wires are provided with projections that rub against the walls of the grooves.

12. Moving blading according to claim 7, wherein the grooves are provided with respective teeth at the tops thereof.

* * * * *